United States Patent [19]

Myking

[11] 4,421,369

[45] Dec. 20, 1983

[54] PANEL MOUNTED CONNECTOR

[76] Inventor: Reidar Myking, P.O. Box 45, N-5100 Isdalst, Norway

[21] Appl. No.: 285,062

[22] Filed: Jul. 20, 1981

[30] Foreign Application Priority Data

Jul. 25, 1980 [NO] Norway ..... 802246

[51] Int. Cl.[3] ..... H01R 13/74

[52] U.S. Cl. ..... 339/36; 339/94 A; 339/130 R

[58] Field of Search ..... 339/36, 38, 88 R, 94, 339/126, 129, 130, 61 R, 61 M

[56] References Cited

U.S. PATENT DOCUMENTS

| | | | |
|---|---|---|---|
| 2,713,670 | 7/1955 | Koch | 339/126 J |
| 2,907,976 | 10/1959 | Damon | 339/126 J |
| 2,962,688 | 11/1960 | Werner | 339/36 |
| 3,183,476 | 5/1965 | Sacks et al. | 339/94 R |
| 3,396,360 | 8/1968 | Piaget | 339/94 R |
| 3,670,289 | 6/1972 | Bruner | 339/130 C |
| 4,274,690 | 6/1981 | Hargett et al. | 339/130 R |

FOREIGN PATENT DOCUMENTS

| | | | |
|---|---|---|---|
| 2041982 | 4/1971 | Fed. Rep. of Germany . | |
| 2270695 | 12/1975 | France | 339/88 R |

*Primary Examiner*—John McQuade
*Attorney, Agent, or Firm*—Kenyon & Kenyon

[57] ABSTRACT

Contact-forming coupling means for a current conductor cable for electrode welding having two clamp members of electrically insulating material for fastening a conductor portion to a fastening plate by abutting opposite sides of the latter by means of a nut and a plate spring clamped against one clamp member on the rear side of the fastening plate. The other clamp member is located on the front side to the fastening plate in a rubber sleeve for physical protection of the coupling means and for providing with the fastening plate a seal against fluid. An endways and outwardly projecting collar portion of the sleeve provides extra physical protection for the coupling means and an additional seal against fluid for an inserted element in the form of either a cooperating coupling means connected to the current conductor cable or a closing plug.

10 Claims, 2 Drawing Figures

-FIG.2-
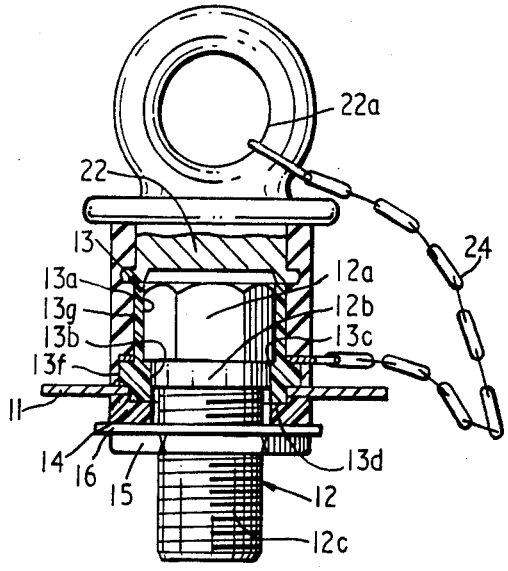
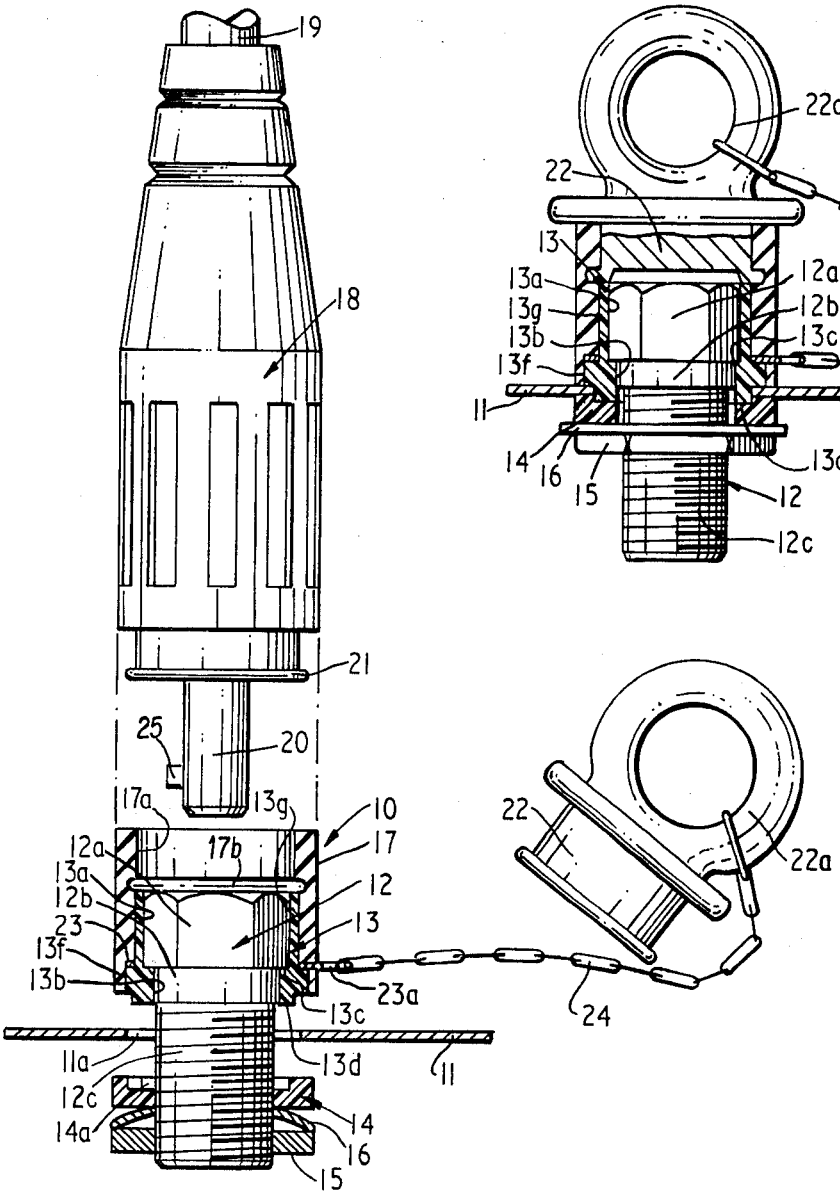
-FIG.1-

PANEL MOUNTED CONNECTOR

This invention relates to a contact-forming coupling means for cooperatively engaging coupling means connected to a current conductor cable for electrode welding.

In the present case, the question is a coupling means which is to be used in connection with electrode welding where rather large quantities of current are to be conveyed through the coupling means. In the contact-forming current conductor portions of cooperating coupling means, special problems arise which is partly due to the passage of heat in the current conductor portions with such large amounts of current and partly due to the conditions at the location of use, especially humidity and in connection with this the usual careless and heavy handed treatment of the equipment at that location.

A coupling means of the type with which this invention is concerned (hereinafter referred to as a first coupling means) is adapted to receive within itself a current conductor portion of a second type of coupling means. In order to achieve the least possible heat movement at the contact points between the current conductor portions of the first and second coupling means, it is critical that the current conductor portions fit exactly into each other. This objective can be relatively easily achieved with coupling means of one and the same manufacture. However, there is a tendency for coupling means of different makes having to be used with one another at one and the same location of use. In this connection, adaptation of the coupling means of different makes from one another has been tried in shape as well as in dimensions. This is simplest as regards the current conductor portions, while as regards the clamp member of the first coupling means or the holder member of the second coupling means deviations occur which create certain complications.

Hitherto the first coupling means has been secured so that it projects endways outwardly from the fastening plate on a coupling box, with a clamp member terminated substantially flush with the outer end of the current conductor portion. In such a case, there is the possibility of being able to adapt the current conductor portions of the respective first and second coupling means in a relatively easy manner relative to each other, even if coupling means are employed of different manufacture.

A disadvantage of a first type of coupling means as used hitherto, is that it does not provide any shield against rain water and other moisture. It is apparent that such undesired moisture in the contact between the current conductor portions creates difficulties. For one thing, it is usual that the current conductor portions, as a consequence of catalysis between the current conductor portions, "grow" fast to each other simultaneously with the occurrence of bad current contact between the current conductor portions with, as a consequence of this, extra heat movement between the current conductor portions.

Hitherto, it has been customary to produce clamp members or outer sleeves of the first coupling means of Bakelite. By this there is achieved electrical insulation, as well as heat insulation, relative to the current conductor portion and, in addition, there is also attained thereby, sufficient rigidity between the clamp member and the current conductor portion so that these can be held in intentionally precise engagement with each other under various working conditions, that is to say under different heat conditions and under different stress conditions. A substantial disadvantage with such clamp members of Bakelite is, however, that the clamp member is vulnerable to knocks and jolts and other stress forces. With the often relatively careless and heavy handed treatment which occurs at work locations with such equipment, there is an extensive danger and tendency of breakage of the Bakelite sleeve and with this the danger of operational cessation and problems in connection with replacement of the damaged clamp member and the like.

As a consequence of the rigidity of the Bakelite clamp member, it is also difficult to obtain precise adaptation between the first and second coupling means and it is especially difficult to obtain a fluid tight seal between the clamp member on the first coupling means and the holder means on the second coupling means even in such instances where holder means of soft rubber is employed on the second coupling means.

In order to prevent the penetration of moisture to the current conductor portions of two coupling means when coupled together, it has been proposed to extend the peripheral portion of the Bakelite clamp member in an axial direction with a collar-shaped portion which will surround the foremost portion of the holder means of the second coupling means. Consequently, as regards coupling means produced at one and the same factory, the sealing problems can be countered to a significant degree while, at the same time, problems are created for coupling means of another make, especially in those instances where the holder means of the second coupling means has a large diameter relative to the inner diameter of the collar-shaped portion. Furthermore, the sealing problems are certainly not relieved in those cases where the holder means of the second coupling means has a small diameter relative to the inner diameter of the collar-shaped portion. Another problem with the collar portion of the Bakelite clamp member is that it is especially vulnerable to being broken in pieces by knocks, jolts and similar stresses.

With the present invention the aim is to produce a solution where a first coupling means can be designed more robustly and at the same time more operatively reliable and for one thing can withstand rather heavy handed handling together with various conditions of humidity, without being damaged.

From Norwegian Pat. No. 138,834 it is known to employ rubber insulation sleeves in connection with a cable joint means, that is to say a coupling means of the said second type, the current conductor portion itself being adapted to be received in semi-permanent, relatively firm connection with the rubber sleeve. It is known in this connection to let the end edge of the rubber sleeve on the one joint means, which has an internal current conductor portion, form an endways sealing abutment against the end edge of the rubber sleeve on the second joint means which has a projecting stem-shaped current conductor portion.

In this instance, one is dependent upon the locking engagement between the current conductor portions in order to ensure sealing abutment between axially counter-thrusting sealing surfaces.

In practice, it is wholly unacceptable to allow a rubber sleeve to form a direct abutment against the current conductor portion. The reasons for this are several. Firstly, the movement of heat in the current conductor portion has the effect that the rubber in the rubber sleeve has a tendency of contacting the current conductor portion to crumble up and lose the intended properties of the rubber. Secondly, it is difficult to counteract turning or displacement of the current conductor portion relative to the rubber sleeve, especially after the crumbling up process has begun. Thirdly, it is difficult to produce a rubber material which has sufficient rigidity and at the same time sufficient elasticity and shock-absorbing effect. In all cases such properties will be easily altered by repeated heating of the rubber sleeve from the current conductor portion.

From West German Offenlegungsschrift No. 2,041,982 a joint connection is known bbetween a first joint means with two parallel outwardly projecting current conductor pins and a second joint means with two corresponding cavities for the reception of their respective current conductor pin in contact with a co-operating second current conductor portion. The current conductor portions of the two joint means are surrounded by a sleeve-forming means of rubber and the sleeve of the first joint means has an outwardly projecting sleeve portion which is adapted to receive within itself a neck-shaped portion on the sleeve of the second joint means, a ring-shaped bead on the neck-shaped portion being adapted to form a snap engagement with an annular groove on the inner side of the sleeve portion of the first joint means. By this there can be formed a fluid-tight seal between the joint means.

The aim is to obtain a corresponding fluid tight seal between a joint means according to Norwegian Pat. No. 138,834 and the coupling means according to the present invention.

Accordingly, the present invention resides in contact-forming coupling means for cooperatively engaging coupling means connected to a current conductor cable for electrode welding and comprising a current conductor portion, first and second clamp members formed from an electrical insulating material and adapted to engage each other to support said current conductor portion on a fastening plate, said first clamp member being arranged to be fastened non-turnably to said current conductor portion and to form an abutment against one side of said fastening plate and said second clamp member being arranged to be secured via said current conductor portion in abutment with the opposite side of said fastening plate, said first clamp member having a fastening portion surrounding said current conductor portion while projecting endways outwardly from said fastening plate, a sleeve composed of elastically yielding material surrounding and permanently connected to said fastening portion, said sleeve having a collar portion which projects a distance endways outside said current conductor portion radially spaced from the latter.

Preferably, the current conductor portion is provided with an internal cavity having a keyhole-like cross-section for the reception of a projecting current conductor stem with laterally directed locking pin on said coupling means connected to the current conductor cable.

By allowing the clamp member of the electrically insulating, relatively rigid material to be surrounded by a rubber sleeve the clamp member can be protected in a simple manner against knocks and jolts and at the same time achieve a fluid tight joint between the clamp member and the fastening plate. In addition, by allowing the rubber sleeve to project a distance endways outside the current conductor portion one can effectively counteract foreign bodies coming into contact with the current conductor portion of the coupling means, on such a stationarily arranged coupling means, when the coupling means is in the unused condition, that is to say when it is not in contact with a corresponding coupling means or cable joint means according to Norwegian Pat. No. 138,834. Alternatively, there can be inserted in the outwardly projecting rubber sleeve portion a sealing, electrically insulated plug which prevents foreign bodies coming into contact with current conductor means and which gives fluid sealing for the current conductor means in all kinds of weather and wind. By arranging the rubber sleeve at a radial distance from the current conductor portion the plug and the corresponding coupling means can be respectively pushed in as an insertion means in the outer end of the rubber sleeve and provide an effective fluid seal for the current conductor portion.

It is preferred that there is deposited between a collar portion in the fastening portion of the first clamp member and a corresponding end surface on the surrounding sleeve a fastening ring with a fastening eye which projects radially outwards from the coupling means at the inner end of the sleeve. By this it is possible to fasten the plug with a chain directly to the coupling means and push in the plug into the coupling means immediately there has to be a need for it. The chain fastening on the rubber sleeve can be produced hereby in one piece with the coupling means, something which provides manufacturing as well as use advantages.

In order that the invention can be more clearly understood, a convenient embodiment thereof will now be described, by way of example, with reference to the accompanying drawings in which:

FIG. 1 is a longitudinal section of a coupling means and a view of a cooperating coupling means fastened to a joint cable.

FIG. 2 is a longitudinal section of the coupling means of FIG. 1 in connection with a closing plug.

Referring to FIG. 1, there is shown a coupling means 10 which is to be secured to a fastening plate 11 in a stationary or mobile coupling box (not shown).

The coupling means 10 is provided with a current conductor portion 12 having an outer hexagonal head 12*a*, an inner existing cylindrical collar portion 12*b* and a relatively elongate, hollow stem portion 12*c* with external screw threads. The hexagonal head 12*a* is received in a corresponding cavity 13*a* in a first clamp member 13 of Bakelite, while the collar portion 12*b* is received in an inner existing cavity 13*b* in the clamp member 13, and both current conductor portions 12*a*, 12*b* are received with a relatively narrow fit in the associated cavities 13*a*, 13*b*. The stem portion 12*c* is led with a free fit through a bore 11*a* in the fastening or mounting plate 11. The clamp member 13 has a shoulder portion 13*c* which forms an endways abutment against the fastening plate 11 around the bore 11*a*, while a short annular connecting union or extension 13*d* projects inwards into the bore 11*a* and forms a guide for the clamp member in the bore 11*a*. The extension 13*d* forms a pin-shaped radial projection which is adapted to be received in a corresponding cavity 14*a* in a second clamp member which forms an endways abutment against the fastening plate 11 around the bore 11*a* on the opposite side of the plate 11 relative to the clamp member 13. The clamp members 13 and 14 are thus clamped together towards each other on respective sides of the fastening plate 11 by means of a nut 15 which engages stem portion 12*c* of the current conductor portion 12 together with a plate spring 16 which is arranged on the stem portion 12*c* between the nut 15 and the clamp member 14.

Clamp member 13 is designed with moderate wall thickness and is disposed in a rubber sleeve 17. The clamp member 13 is provided with an external outwardly projecting collar portion 13*f* and a graduated, relatively elongate neck portion 13*g*. The rubber sleeve 17 covers the collar portion 13*f* as well as the neck portion 13*g*, that is to say outer fastening portions 13*f*, 13*g*, and projects a certain distance endways outside outer ends of the neck portion 13*g* and the current conductor portion 12 with a sleeve portion 17*a*. By means of the inner portion of the rubber sleeve 17, there is obtained an effective seal against fluid between the fastening plate 11 and the coupling means and by means of the elastically yielding rubber sleeve 17, and especially its outer sleeve portion 17*a*, there is obtained a protection against knocks and jolts on the clamp member 13 and the current conductor portion 12.

A coupling means 18, which is connected to a current conductor cable 19, has an endways outwardly projecting current conductor portion 20 which can be placed in contact with the current conductor portion 12 in the coupling means 10 via collar portion 17*a* of the rubber sleeve 17 during coupling together of the means 10 and 18. With this, an annular projection 21 on the means 18 can be snapped into locking engagement with a corresponding internal annular groove 17*b* in the collar portion 17*a* of the rubber sleeve 17. By this, an effective seal against fluid can be obtained between the coupling means 10 and 18 by means of the collar portion 17*a*. A similar seal against fluid can also be obtained in the inactive condition of the coupling means, that is to say when the means 10 and 18 are not coupled together, by inserting a closing plug 22 in the sleeve portion 17*a*, as is shown in FIG. 2.

The current conductor portion 12 is provided with an internal cavity (not shown) having a keyhole-like cross-section for the reception of the projecting current conductor portion 20 and a laterally directed locking pin 25 thereon.

When the closing plug 22 is to be fastened in position in the collar portion 17*a*, it is advantageous to have the closing plug fixed with a fastening chain in immediate proximity to the coupling means 10. Provision is made for arranging a chain fastening directly on the coupling means 10. The chain fastening consists of a fastening ring 23 having a radially projecting fastening eye 23*a*. The fastening ring 23 itself forms a support against the collar portion 13*f* of the clamp member 13 and is locked in place by the rubber material during the securing of the rubber sleeve 17 on the clamp member 13, only the fastening eye remaining projecting radially outwards from the rubber sleeve 17. The closing plug 22 can hereby easily be firmly hooked to the fastening eye 23*a* with a relatively short chain piece 24 so that the closing plug is readily available at any time. The closing plug 22 is provided with a finger grip 22*a* for ready mounting and dismounting thereof with respect to the sleeve portion 17*a*.

I claim:

1. Contact-forming coupling means for cooperatively engaging coupling means connected to a current conductor cable for electrode welding and comprising a current conductor portion, first and second clamp members formed from an electrical insulating material and adapted to engage each other to support said current conductor portion on a fastening plate, said first clamp member being arranged to be fastened non-turnably to said current conductor portion and to form an abutment against one side of said fastening plate and said second clamp member being arranged to be secured via said current conductor portion in abutment with the opposite side of said fastening plate, said first clamp member having a fastening portion surrounding said current conductor portion while projecting endways outwardly from said fastening plate, a sleeve composed of elastically yielding material surrounding and permanently connected to said fastening portion, said sleeve having a portion which projects a distance endways outside said current conductor portion and radially spaced from the latter.

2. The coupling means of claim 1, wherein the current conductor portion is provided with an internal cavity having a keyhole-like cross-section for the reception of a projecting current conductor stem with laterally directed locking pin on said coupling means connected to the current conductor cable.

3. The coupling means of claim 1 or 2, wherein the fastening portion of the first clamp member has a collar portion between which and a corresponding end surface on the surrounding sleeve is located a fastening ring with a fastening eye projecting radially outwards from the sleeve close to where the clamp members engage.

4. A coupling means for a current conductor portion comprising a first annular clamp member of electrical insulating material having a shaped cavity for receiving a current conductor portion therein in non-rotatable relation and an axial extension at one end for fitting into and through an aperture of a mounting plate;

a second annular clamp member of electrical insulating material coaxial of said first clamp member and having a cavity receiving said extension of said first clamp member; and a rubber sleeve disposed about said first clamp member and having one end projecting coaxially from said first clamp member to define a recess for removably receiving coupling means having a current conductor portion for contacting a current conductor portion in said first clamp means, said rubber sleeve having an opposite end for abutting the mounting plate in sealed relation.

5. A coupling means as set forth in claim 4 wherein said rubber sleeve has an internal annular groove near said one end and adjacent an end of said first clamp member for receiving an annular projection of a coupling means in locking engagement.

6. In combination, a coupling means including a first annular clamp member of electrical insulating material having a shaped cavity for receiving a current conductor portion therein in non-rotatable relation and an axial extension at one end for fitting into and through an aperture of a mounting plate; a second annular clamp member of electrical insulating material coaxial of said first clamp member and having a cavity receiving said extension of said first clamp member; and a rubber sleeve disposed about said first clamp member and having one end projecting coaxially from said first clamp member to define a recess for removably receiving an electrical coupling means for contacting a current conductor portion in said first clamp means, said rubber sleeve having an opposite end for abutting the mounting plate in sealed relation;

a closing plug fitting into said recess of said sleeve; and a chain fastening said plug to said coupling means.

7. In combination, a mounting plate having at least one aperture therein;

a first current conductor portion passing through said aperture of said plate; and a coupling means including a first clamp member on one side of said plate receiving said current conductor portion therein in non-rotatable relation and having an extension fitting through said aperture of said plate, a second clamp member on an opposite side of said plate receiving said current conductor portion and said extension of said first clamp member, and a rubber sleeve about said first clamp member and having a portion extending coaxially from said first clamp member to define a recess at one end, said rubber sleeve sealingly engaging said plate at an opposite end from said one end.

8. The combination as set forth in claim 7 which further comprises a second coupling means sealingly engaged in said recess of said sleeve and having a current conductor portion in electrical contact with said first current conductor portion.

9. The combination as set forth in claim 7 which further comprises a closing plug fitting into said recess of said sleeve and a chain fastening said plug to said coupling means.

10. The combination as set forth in claim 8 wherein said sleeve has an annular groove therein and said second coupling means has an annular projection received in said groove in locking engagement.

* * * * *